United States Patent [19]

Gray

[11] Patent Number: 5,033,190

[45] Date of Patent: Jul. 23, 1991

[54] METHOD FOR CONTROLLING A TUBE EXPANDER

[75] Inventor: Kenneth P. Gray, Syracuse, N.Y.

[73] Assignee: Carrier Corporation, Syracuse, N.Y.

[21] Appl. No.: 572,819

[22] Filed: Aug. 27, 1990

[51] Int. Cl.[5] ..... B23P 15/26

[52] U.S. Cl. ..... 29/890.044; 29/890.033; 29/407; 29/523; 73/49.5; 73/112

[58] Field of Search ..... 29/890.043, 890.044, 29/407, 523; 73/37, 49.5, 112, 116, 865.9, 866.5

[56] References Cited

U.S. PATENT DOCUMENTS

| | | | |
|---|---|---|---|
| 4,120,095 | 10/1978 | Lobourg | 29/407 |
| 4,372,025 | 2/1983 | Behle | 29/407 |
| 4,625,396 | 12/1986 | Ahmed et al. | 29/407 |
| 4,745,678 | 5/1988 | Gray | 29/890.044 |
| 4,766,667 | 8/1988 | Gray | 29/890.044 |
| 4,839,950 | 6/1989 | Stroup | 29/890.044 |
| 4,858,296 | 8/1989 | Gray | 29/890.044 |
| 4,858,305 | 8/1989 | Gray et al. | 29/727 |
| 4,889,679 | 12/1989 | Snyder et al. | 29/890.044 |

*Primary Examiner*—Irene Cuda

[57] ABSTRACT

A method for controlling, in the manufacture of plate fin and tube heat exchangers, the operation of a tube expander of the type that does not expand all hairpin tubes in a heat exchanger simultaneously so that the two legs of each hairpin tube are expanded at the same time. In a preferred embodiment, a supply of pressurized air is directed through one of a selected group of open ended tube legs. Pressure sensors located at the ends other legs within the group detect the tube, if any, at which there an increase in pressure, establishing continuity between that leg and the first leg and thus identifying the two legs under test as parts of the same hairpin. This matched pair of legs is identified for expansion on the same expansion stroke of the expander. Other legs within the group between which there is pressure continuity are similarly detected and identified. Other groups of legs are similarly and progressively selected and matched pairs identified until all matched pairs in the heat exchanger have been identified and expanded.

7 Claims, 3 Drawing Sheets

METHOD FOR CONTROLLING A TUBE EXPANDER

BACKGROUND OF THE INVENTION

The present invention relates to the manufacture of plate fin and tube heat exchangers. Specifically, the invention relates to a method and apparatus for controlling the operation of a tube expander used in one step of the manufacturing process.

In manufacturing a typical plate fin and tube heat exchanger, such as may be used in an air conditioning or refrigeration system or in an engine cooling system, U-shaped or hairpin tubes are inserted into holes in the fins and tubesheets of the heat exchanger until the open ends of the hairpin tubes protrude beyond one of the tubesheets. The walls of the tubes are then expanded radially, using a tube expander, to make firm contact between the fins and the tubes and tubesheets to ensure good heat transfer and structural integrity. The open ends of the hairpin tube legs are also expanded radially to a greater diameter than the remainder of the tube to form a bell or socket. Short U-shaped tubes, or return bends, are then inserted into the belled ends and secured by a suitable process such as welding, brazing or soldering to form a closed fluid flow path within the heat exchanger. U.S. Pat. No. 4,228,573 provides a general description of the entire process of manufacturing plate fin and tube heat exchangers according to one method. U.S. Pat. Nos. 4,850,101 and 4,858,305 provide descriptions of two different methods of manufacturing plate fin and tube heat exchangers incorporating tension tube expanders.

The tension tube expansion process results in an overall decrease in the length of the tube being expanded. It is therefore desirable to expand the two legs of each hairpin at the same time. If only one leg of the hairpin is expanded in a given expansion operation, only that leg will be decreased in length and therefore the end of the other, unrestrained leg will be drawn out of the tubesheet. The increased protrusion of the unexpanded leg can hamper or complicate the expansion of that leg in a subsequent operation.

In some tube expansion methods, including most employing compression expansion, one of which is described in U.S. Pat. No. 4,228,573, and in some employing tension expansion, one of which is described in U.S. Pat. No. 4,584,765, all the hairpin tubes in the heat exchanger are expanded at the same time. Thus both legs of each hairpin tube are expanded simultaneously and the uneven tube protrusion problem does not arise.

In other methods of expansion, such are described in U.S. Pat. Nos. 4,850,101 and 4,858,305, however, something less than all hairpin tubes are expanded in a given expander stroke, with multiple strokes required to expand all the tubes in the heat exchanger. In tube expansion methods of this type, it is necessary that the expander be properly positioned and sequenced to expand both legs of a given hairpin at the same time.

Fluid flow and heat transfer considerations result in various heat exchanger designs having various hairpin tube configurations, complicating the task of hairpin tube leg pair identification. One method sometimes used to identify hairpin tube leg pairs for expansion in the same operation is to provide an operator with a diagram of the tube arrangement in the heat exchanger as an aid in manually positioning the heat exchanger with respect to the expander. This method, of course, is slow, labor intensive and not economical in large scale manufacturing operations. Another method is to use some type of programmable machine controller to control the positioning of the expander with respect to the heat exchanger. U.S. Pat. Nos. 4,850,101 and 4,858,305 describe this method. Programmed control of the expander has limitations, particularly when the size of the heat exchangers being manufactured or the complexity of the tube arrangements increases or if it is desired to use the same expander to manufacture more than one type of heat exchanger. Each different model of heat exchanger expanded would require a separate program and program size would increase as heat exchanger size and complexity increased. In addition, there must be some means provided for matching the control program to the specific design of heat exchanger being expanded and to verify that the expander is properly indexed to the heat exchanger at the start of an expansion operation. Moreover, the programmed controller is "blind" to programming, setup and indexing errors, leading to the possibility of manufacturing defects until the error or errors are discovered by other means, such as inspection, and corrected.

SUMMARY OF THE INVENTION

It is therefore an object of the present invention to provide a method for controlling the operation of a hairpin tube expander used in the manufacture of plate fin and tube heat exchangers and an apparatus for implementing the method.

It is another object of the present invention to introduce a method for controlling a tube expander in which the two legs of a given hairpin tube are automatically identified for expansion, insuring that the two legs will be simultaneously expanded and that the expansion process will be completed without errors.

It is a further object of the present invention to provide a tube expander controller that is flexible and able to accommodate heat exchangers having differing hairpin tube configurations with no change in programming or setup required upon a change in the type of heat exchanger being manufactured using the expander.

The present invention achieves these objects, as well as others, by providing a method for controlling the operation of a tube expander in which pairs of legs within a selected group are tested for the ability to conduct a suitable signal from one to the other leg of the pair, such ability indicating that the legs of the pair are two legs of the same hairpin. The legs within the selected group so matched are then identified for simultaneous expansion by the expander. The process is repeated with other selected groups of tube legs until all legs in the heat exchanger have been matched and identified for simultaneous expansion.

In a preferred embodiment, a supply of pressurized air is directed through one of a selected group of open ended tube legs. Pressure sensors located at the ends of other legs within the group detect the tube, if any, at which there is an increase in pressure, establishing continuity between that leg and the first leg and thus identifying the two pressurized legs as parts of the same hairpin. This pair of matched legs is identified for expansion on the same expansion stroke of the expander. Other legs within the group between which there is pressure continuity are similarly detected and identified. Other groups of legs are similarly and progressively selected and continuity pairs identified until all continuity pairs in the heat exchanger have been identified for simultaneous expansion.

Because the invention actively verifies that an identified pair of tube legs are parts of the same hairpin and does not rely blindly on a fixed program to determine which tubes to expand on a given expander stroke, the invention allows the expander to be used on heat exchangers of different sizes and tube configurations without requiring manual control or a different control program for each heat exchanger type. For the same reason, the invention also eliminates the possibility that the expander will fail to expand both legs of the same hairpin at the same time.

BRIEF DESCRIPTION OF THE DRAWINGS

The accompanying drawings form a part of the specification. Throughout the drawings, like reference numbers identify like elements.

DESCRIPTION OF THE PREFERRED EMBODIMENTS

Figure 1:
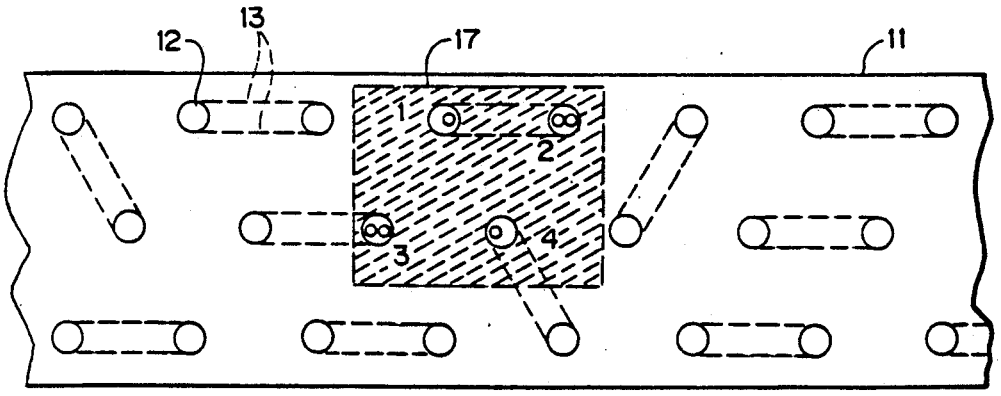
FIG. 1 is an elevation view of a section of the face of a heat exchanger tubesheet.

The principle upon which the present invention is based is that a heat exchanger hairpin tube, being essentially a single, continuous length of tubing, will conduct a suitable signal transmitted into one end of the tube to a receiver located at the other end of the tube. Therefore, if a signal is transmitted into a given tube leg and the signal is received by a receiver located at the end of another tube leg, then the two legs "match," i.e. the two legs are parts of the same hairpin. Conversely, if a signal return is not received at the end of a given tube leg when a signal is transmitted into another tube leg, the two legs do not match and are not parts of the same hairpin. In the preferred embodiment described here, the means for transmitting a signal into one tube leg is to increase the air pressure in that leg and the signal return therefore expected is the corresponding increase in air pressure in the other tube leg of the same hairpin. Other signalling means, can be employed, such as an acoustic or light signal, generated and received by suitable transmitters and receivers. Illustrating the workpiece with and on which the present invention is applied, FIG. 1 depicts a section of the face of a typical heat exchanger tubesheet 11. Tubesheet 11 contains a plurality of tube holes, such as hole 12, arranged in a plurality of straight roWs. Tubesheet 11 has a $1 \times 0.866$ arrangement, in that if the holes in a given row have a center-to-center spacing of one unit of length, then the distance between rows is 0.866 (sine 60°) unit of length and the hole centers in a given row are offset one half unit of length along the common row centerline from perpendiculars dropped from the centers of holes in the adjacent rows, resulting in the distance between the center of a given hole in one row and the centers of the nearest holes in adjacent rows also being one unit of length. All the hairpin tubes laced or inserted through the tubesheet have a common bend radius, a radius that results in a distance between leg axial centerlines of one unit of length. Hence, the legs of a given hairpin tube may be laced through two adjacent holes on the same row or through a hole on one row and either of the two holes in a second, adjacent row that are closest to the hole in the first row. With the obvious exception of the holes in the rows adjacent to the edges of the tubesheet, for any given hole in the tubesheet, a hairpin tube may be laced through that hole and any one of the six holes that surround the given hole. The dotted lines, e.g. lines 13, connecting holes in tubesheet 11 represent one possible hairpin tube lacing arrangement through tubesheet 11.

Figure 2:
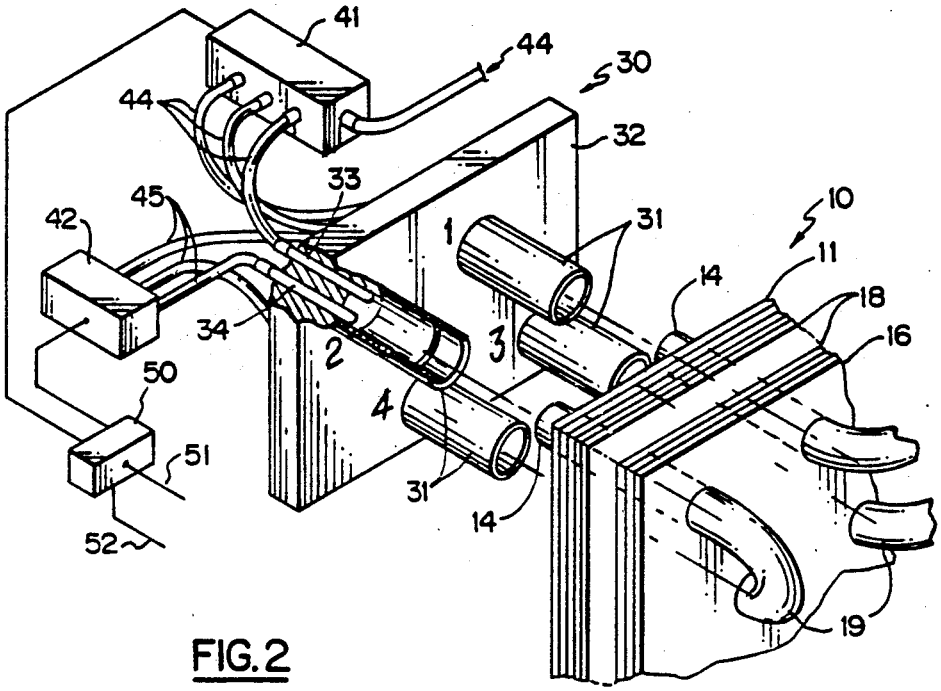
FIG. 2 is an isometric view, partially broken away, of one embodiment of the present invention in position to be used on a heat exchanger for identifying matched leg pairs.

FIG. 2 depicts probe array 30 in position to be mated to partially completed heat exchanger 10 in order to determine which, if any, of the hairpin tube legs 14 in a selected group of legs protruding out of tubesheet 11 may be matched. Heat exchanger 10, at this stage of manufacture, comprises tubesheets 11 and 16, plate fins 18, hairpin tube legs 14 and hairpin U-bends 19. Array 30 comprises four probes 31, designated respectively probe 1, probe 2, probe 3 and probe 4, mounted on probe base 32. Each probe 31 is hollow and configured and sized so as to mate with the end of a tube leg 14 in a substantially pressure tight fit. Extending through probe base 32 and into each probe 31 is either a transmitter passage 33, a receiver passage 34 or both types of passages.

When probe array 30 is in position on the face of tubesheet 11 and mated to a selected group of four tube legs 14 for matching of leg pairs for expansion, it will make "footprint" 17 (FIG. 1) on tubesheet 11. With the tubesheet and hairpin tube arrangement as depicted and described and the four probe array arrangement shown, it can be seen that a matched pair of legs 14 can be present between any two probes 31 in array 30 except probes 2 and 3 and that, with array 30 positioned as shown, there is one match (between probes 1 and 2). It can also be seen that there are eight possibilities for matches within any selected group of four tube legs: none; 1-2 only, 1-3 only; 1-4 only; 2-4 only; 3-4 only; 1-2 and 3-4; and 1-3 and 2-4. The number of matched pairs within any given group of four legs may range from zero to two. Since all matches with the tube leg at probe 1 that exist within the selected group of four tubes can be identified by transmissions into that tube leg and receptions, if any, at one of the other tube legs in the group, there is no need for a receiver passage into probe 1. Similarly, since all matches with the tube leg at probe 4 can be identified by transmissions into other tube legs in the selected group and a reception if any, at the tube leg at probe 4, there is no need for a transmitter passage into probe 4. Therefore, in the four probe arrangement of array 30, there is both a transmitter passage 33 and a receiver passage 34 into probes 2 and 3, but only a transmitter passage 33 into probe 1 and only a receiver passage 34 into probe 4. While for clarity only the transmitter passage 33, and its connection with a transmitter tube 44, in probe 2 is shown, other transmitter tubes 44 also connect transmitter passages 33 into probes 1 and 3 with signal transmitter 41. Similarly, while only the receiver passage, and its connection with a receiver tube 45, in probe 2 is shown, other receiver tubes 45 connect receiver passages 34 of probes 3 and 4 with signal receiver 42.

Signal transmitter 41 is a suitable control air manifold that directs a stream of pressurized air from air supply 44 through a selected transmitter tube 44, transmitter passage 33 and probe 31 to a tube leg 14 in response to instructions from control device 50. Air supply 44 may be from any suitable source of pressurized air. Signal receiver 42 is a suitable device, such as an arrangement of pressure switches, that detects an increase in pressure, through an appropriate probe 31, receiver passage 34 and receiver tube 45, at a tube leg 14 and transmits information on that detection to control device 50.

Figure 3:
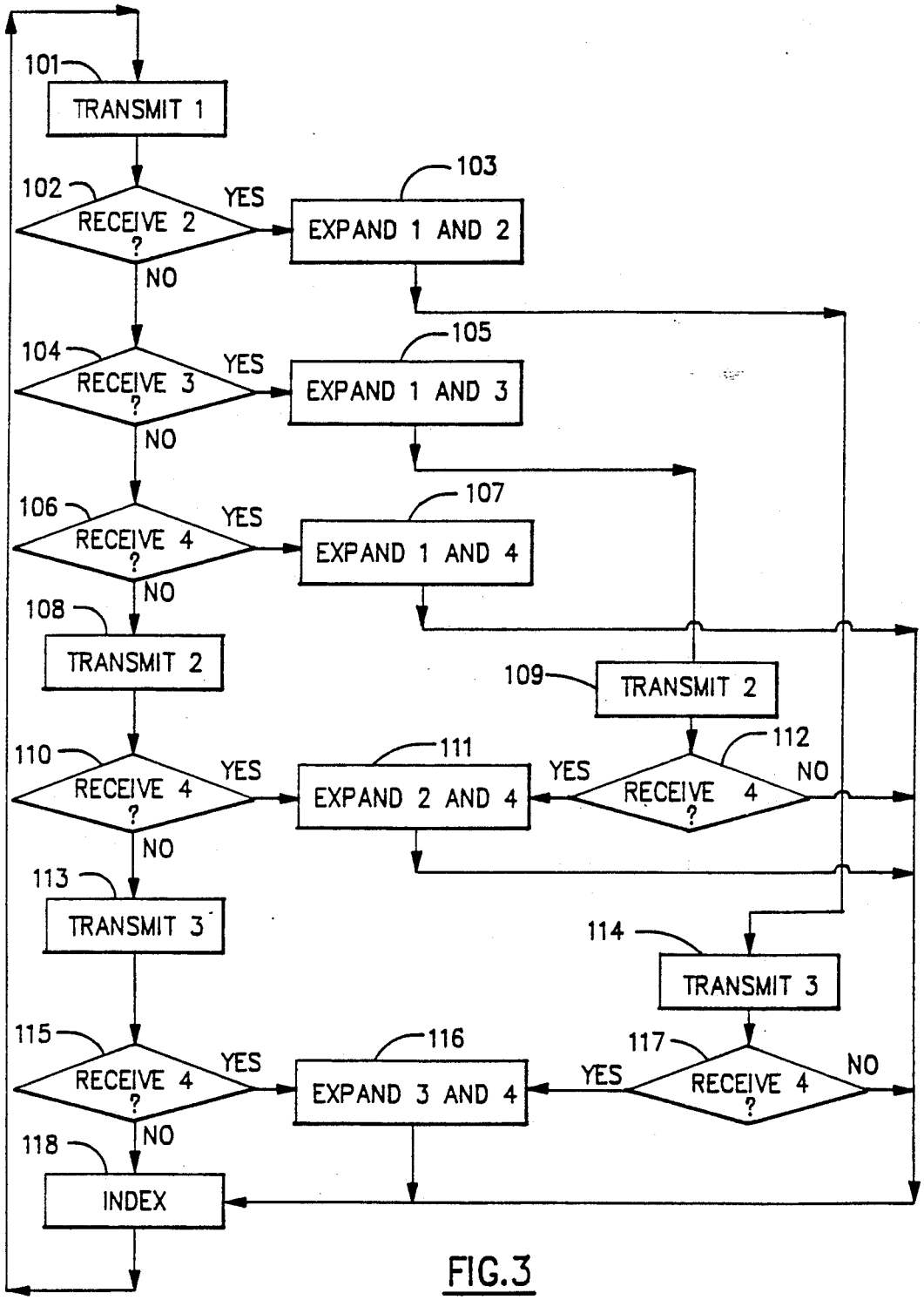
FIG. 3 is a logic diagram illustrating the logic programmed into the control device to direct the operation of the probe array and the expander.

Control device 50 comprises suitable mechanical and electrical components to enable it to perform the logic steps described below. FIG. 3 is a logic diagram illustrating the program logic within control device 50 that receives inputs from signal receiver 42 (FIG. 2) and produces operating instructions to signal transmitter 41 (FIG. 2), a suitable probe array positioner (not shown), the tube expander (not shown) and a suitable tube expander positioner (not shown). Throughout the diagram, the term "TRANSMIT [NUMBER]" means "Transmit a signal into the tube leg mated with probe [NUMBER]." The term "RECEIVE [NUMBER]?" means "Is there a signal return from the tube leg mated to probe [NUMBER]?". The term "EXPAND [NUMBER] AND [NUMBER]" means "Issue an instruction to expand the pair of tube legs mated to probes [NUMBER] and [NUMBER] at the same time." And the term "INDEX" means "Issue an instruction to reposition the probe array to another group of tube legs." The numbers in the diagram designate the four tube legs selected for identification during a single positioning of the probe array and correspond to the probe numbers shown in FIG. 2. Note that, for the reasons discussed above, program logic steps "RECEIVE 1?" and "TRANSMIT 4" are not required in the loop.

The program logic can best be described by a series of examples, each commencing with the heat exchanger being positioned at the expander and the probe array being aligned with a first selected group of four tube legs:

Example 1, No Matched Pairs in the Selected Group. The matching process is initiated by transmitting a signal into leg 1, block 101. There being no matches, there will be NO answers at blocks 102, 104 and 106. The program will proceed to block 108 and direct a transmission into leg 2. Receiving a NO answer at block 110, the program will step to block 113 and direct a transmission into leg 3. Receiving a NO answer at block 115, the program will continue to block 118, where the probe array will index, or reposition to a second group of tube legs. The program will then recycle to block 101 to commence another matching cycle on the new, second group.

Example 2, A Match Only Between Legs 2 and 4 in the Selected Group. The cycle commences by transmitting a signal into leg 1, block 101. There will be NO answers at blocks 102, 104 and 106. Proceeding then to block 108, the program will direct a transmission into leg 2. There will be a YES answer at block 110, so the program will step to block 111 and issue an instruction to expand legs 2 and 4, then proceed to block 118, indexing and returning to block 101.

Example 3, Matches Between Legs 1 and 3 and Between Legs 2 and 4 in the Selected Group. The cycle commences by transmitting a signal into leg 1, block 101. There will be a NO answer at block 102 but a YES answer at block 104, so the program steps to block 105 where an instruction is issued to expand legs 1 and 3 simultaneously. Then proceeding to block 107, the program will issue a direction to transmit into leg 2. There will be a YES answer at block 112, so the program will direct the expander to expand legs 2 and 4 simultaneously, block 111. The program then proceeds to block 118 to index to a second group of legs and then recycles to block 101 to commence another matching cycle.

Example 4, Matches Between Legs 1 and 3 and Between Legs 2 and 4 in the Selected Group. Starting at block 101, a signal is transmitted into leg 1. There will be a NO answer at block 102, but a YES answer at block 103, so the logic proceeds to block 105 and issues an instruction to expand legs 1 and 3. When a signal is transmitted into leg 2, block 109, a YES answer is received at block 112 and an instruction is issued to expand legs 2 and 4. The logic then proceeds to block 118, indexes and returns to block 101.

Example 5, Matches Between Legs 1 and 2 and Between legs 3 and 4 in the Selected Group. Upon transmitting a signal into leg 1, block 101, there will be a NO answer at block 102, so the program will issue a signal to expand legs 1 and 2, block 103. Proceeding to block 114, a signal will be transmitted into leg 3 and a YES answer received at block 117. The program will therefore issue an instruction to expand legs 2 and 4, block 116. The logic then proceeds to block 118, indexes and returns to block 101.

One skilled in the art will appreciate that the logic depicted in FIG. 3, as illustrated by the above examples, will cover all possibilities of leg matches while avoiding unnecessary or redundant transmissions.

The probe array and tube expander positioners mentioned but not illustrated can be conventional devices for either manually or automatically positioning, extending and retracting the probe array and the tube expander with respect to the heat exchanger in the process of manufacture. The tube expander mentioned but not illustrated can be a tube expanding machine of the tension type that expands heat exchanger hairpin tube legs in pairs, e.g. the apparatus described in U.S. Pat. No. 4,858,305.

Figure 4:
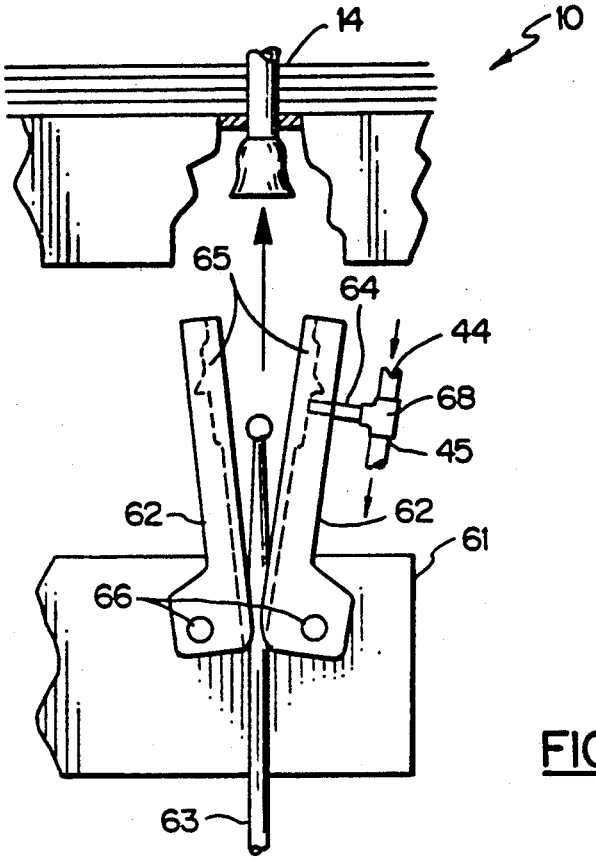
FIG. 4 is a top plan view of a portion of a tension tube expander incorporating a second embodiment of the present invention.
Figure 5:
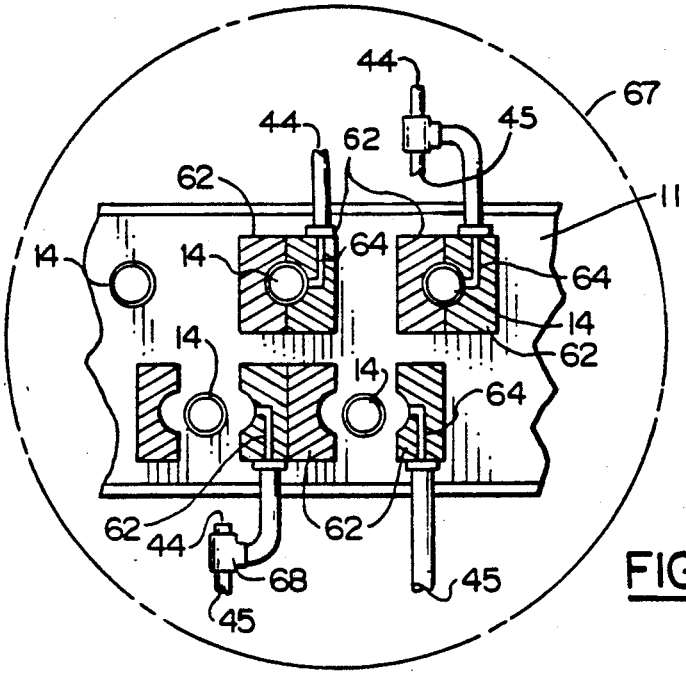
FIG. 5 is a sectioned rear elevation view of a portion of a tension tube expander incorporating a second embodiment of the present invention.

In the embodiment described above, the identification of matched pairs of tube legs is accomplished separately and in advance of the simultaneous expansion of the matched pairs. It is possible and perhaps more desirable to combine the functions of matching and expansion into a single apparatus. FIGS. 4 and 5 illustrate how the two functions can be so combined.

FIG. 4 is a top elevation view of a portion of tension tube expander 60 positioned but not mated with hairpin tube leg 14, which extends through tubesheet 11 of heat exchanger 10. Gripper jaws 62 are mounted to gripper base 61 in such a manner that by appropriate means (not shown) they swing open about pivots 66 before expander 60 engages or mates with a group of tube legs 14. After mating, gripper jaws 62 close around tube leg 14 and grasp the leg firmly as expander rod 63 is driven into and expands tube leg 14. For clarity, FIG. 4 shows only one pair of gripper jaws but, as shown in FIG. 5, a sectioned rear elevation view of gripper jaw array 67, expander 60 comprises four pairs of gripper jaws 62 so that the expander can mate with four tube legs at a time. For clarity, FIG. 5 shows two pairs of gripper jaws 62 open and two pairs closed, but in operation all four pairs of gripper jaws operate in unison, being open or shut at the same time. Each gripper jaw 62 contains a cavity 65 to accommodate the end of a tube leg 14 and to provide clearance for the travel of expander rod 63. With the provision of appropriate additional features as shown in FIGS. 4 and 5, the signal transmission and reception functions of probe array 30 (FIG. 2) can be incorporated into gripper jaw array 67 and the need for a separate probe array eliminated. In one gripper jaw 62 of each pair of jaws is combined transmitter/receiver passage 64. Through tees 68, a transmitter tube 44 and a receiver tube 45 are connected to the transmitter/receiver passage 44 of one gripper jaw 62 in two of the four pairs of jaws that comprise jaw array 67. To transmitter/receiver passage 44 of one jaw of one of the remaining pairs of gripper jaws 62 is connected a transmitter tube 44 and to transmitter/receiver passage 44 of one jaw of the other of the remaining pairs of gripper jaws 62 is connected a receiver tube 45. Thus the transmitter and receiver configuration of the probes in probe array 30 (FIG. 2) is emulated in gripper jaw array 67. By the use of tees 68, the need for more than one transmitter/receiver passage per pair of gripper jaws is eliminated. The jaws do not close to a pressure tight seal, but the leakage of air between the closed jaws is small relative to the amount of air supplied to the jaw cavity and the air directed into the tube leg is sufficient to cause a detectable increase of air pressure in the other tube leg of a matched pair of legs.

While preferred embodiments of the present invention have been illustrated and described, ones skilled in the art may develop variations, such as the number of probes in an array, that remain within the scope of the invention. It is intended, therefore, that scope of the invention be limited only by the below claims.

What is claimed is:

1. A method of resolving whether a first hairpin tube leg and a second hairpin tube leg are legs of the same hairpin comprising the steps of:

transmitting a signal into said first leg, ascertaining whether there is a signal return from said second leg, and determining, by the presence of said signal return, that said legs are legs of the same hairpin, or, by the absence of said signal return, that said legs are not legs of the same hairpin.

2. A method of determining, from within a group of hairpin tube legs, any pairs of legs that match as together being legs of the same hairpin comprising the steps of:

testing each possible matched pair of legs for the ability to conduct a signal between legs, identifying as matched each pair of legs that has said signal conducting ability.

3. The method of claim 2 in which said testing and identification steps comprise the substeps of:

selecting a first subgroup of legs from within said group for testing, testing each possible matched pair of legs within said first subgroup for the ability to conduct a signal between legs, and progressively selecting other subgroups of legs for testing and identification of matched pairs until all possible matched pairs in said group have been tested and all matched pairs identified.

4. A method of controlling a hairpin tube expander used in manufacturing plate fin and tube heat exchangers so that both legs of each hairpin tube in a heat exchanger being manufactured are expanded simultaneously comprising the steps of:

selecting a first group of legs in said heat exchanger for testing, testing each possible matched pair of legs within said first group for the ability to conduct a signal between legs, identifying as matched each pair of legs that has said signal conducting ability, issuing an instruction to said expander to simultaneously expand pairs of legs within said first group that have been identified as matched, and progressively selecting other groups of legs for testing and identification of matched pairs and issuing of expansion instructions until all possible matched pairs of legs in said heat exchanger have been tested, matched pairs identified and all legs expanded.

5. The method of claim 4 in which said signal conduction testing step comprises testing the ability to conduct an increase in air pressure from one leg to another of a possible matched pair, and said identification step comprises identifying those pairs of legs that can conduct an air pressure increase as matched and those pairs that cannot conduct an air pressure increase as not matched.

6. The method of claim 4 in which said signal conduction testing step comprises testing the ability to conduct an acoustic signal from one leg to another of a possible matched pair, and said identification step comprises identifying those pairs of legs that can conduct an acoustic signal increase as matched and those pairs that cannot conduct an acoustic signal as not matched.

7. The method of claim 4 in which said signal conduction testing step comprises testing the ability to conduct a light signal from one leg to another of a possible matched pair, and said identification step comprises identifying those pairs of legs that can conduct a light signal as matched and those pairs that cannot conduct a light signal as not matched.

* * * * *